United States Patent [19]

Wang

[11] Patent Number: 5,074,883

[45] Date of Patent: Dec. 24, 1991

[54] PROCESS FOR PROVIDING POLYAMIDE MATERIALS WITH STAIN RESISTANCE

[75] Inventor: Shou-Lu G. Wang, St. Paul, Minn.

[73] Assignee: Minnesota Mining and Manufacturing Company, St. Paul, Minn.

[21] Appl. No.: 448,678

[22] Filed: Dec. 11, 1989

[51] Int. Cl.[5] ..... D06M 15/00

[52] U.S. Cl. ..... 8/115.6; 8/DIG. 21; 427/393.4

[58] Field of Search ..... 8/115.55, 115.56, 115.59, 8/115.68, DIG. 21, 495, 115.6; 524/436, 841; 427/393.4

[56] References Cited

U.S. PATENT DOCUMENTS

| | | | |
|---|---|---|---|
| 2,205,883 | 6/1940 | Graves | 149/5 |
| 3,408,319 | 10/1968 | Rau | 264/23 |
| 3,961,881 | 6/1976 | Sumner et al. | 8/17 |
| 3,994,744 | 11/1976 | Anderle et al. | 134/4 |
| 4,081,383 | 3/1978 | Warburton, Jr. et al. | 252/8.6 |
| 4,334,876 | 6/1982 | Beier et al. | 8/94.19 |
| 4,388,372 | 6/1983 | Champaneria et al. | 428/395 |
| 4,408,995 | 10/1983 | Guth et al. | 8/477 |
| 4,448,581 | 5/1984 | Fennekels et al. | 8/137 |
| 4,501,591 | 2/1985 | Ucci et al. | 8/495 |
| 4,526,581 | 7/1985 | Prentiss et al. | 8/94 |
| 4,579,762 | 4/1986 | Ucci et al. | 428/95 |
| 4,592,940 | 6/1986 | Blyth et al. | 428/96 |
| 4,695,497 | 9/1987 | Nagy, Jr. et al. | 428/96 |
| 4,699,812 | 10/1987 | Munk et al. | 427/393 |
| 4,822,373 | 4/1989 | Olson et al. | 8/115 |
| 4,875,901 | 10/1989 | Payet et al. | 8/115.56 |

FOREIGN PATENT DOCUMENTS

| | | |
|---|---|---|
| 0090788 | 5/1983 | European Pat. Off. . |
| 0235980 | 9/1987 | European Pat. Off. . |
| 0235989 | 9/1987 | European Pat. Off. . |

OTHER PUBLICATIONS

Sulfonation and Related Reactions, E. E. Gilbert, Interscience Publishers, 1965.

Phenolic Resins, A. Knopf et al., Springer-Verlag, 1985.

*Primary Examiner*—Prince Willis, Jr.

*Assistant Examiner*—John F. McNally

*Attorney, Agent, or Firm*—Gary L. Griswold; Walter N. Kirn; Carole Truesdale

[57] ABSTRACT

A method for imparting to fibrous polyamide materials stain resistance to acid colorants is provided. The method comprises (a) applying by immersion or padding of said material or applying to the fiber during spinning thereof 0.01 to 0.3 weight percent based on the weight of said polyamide material of a stain resist agent and (b) applying sufficient stain resist agent by foam application to provide a stain resistance rating of at least about 5.

9 Claims, 1 Drawing Sheet

4
5
3
6
2
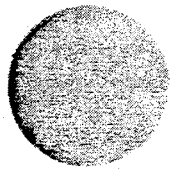
7
1
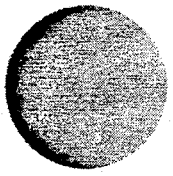
8

PROCESS FOR PROVIDING POLYAMIDE MATERIALS WITH STAIN RESISTANCE

This invention relates to a process for providing fibrous polyamide materials such as nylon carpet with stain resistance and polyamide materials as treated.

Fibrous polyamide articles such as nylon carpets are particularly susceptible to staining by natural and artificial acid colorants such as are commonly found in many foods and beverages. A need has long been felt for processes for economically providing such fibrous polyamide articles with resistance to staining by acid colorants. Particularly desirable are processes by which durable stain resistance can be imparted to fibrous polyamide articles during conventional processing and treating operations.

U.S. Pat. No. 4,501,591 (Ucci et al.) discloses a process for providing stain resistant polyamide carpets in which a sulfonated phenol-formaldehyde condensation product and an alkali metal silicate are added to the dye liquor in a continuous dyeing process, followed by steaming, washing, and drying the carpet.

U.S. Pat. No. 4,592,940 (Blyth et al.) discloses a process for imparting stain resistance to nylon carpet by immersing the carpet in a boiling aqueous solution of a selected phenol-formaldehyde condensation product at a pH of 4.5 or less. The process is carried out in conventional beck dyeing apparatus subsequent to dyeing (generally at a pH of 6.5 to 8.0) by either acidifying the bath to 4.5 or draining the dye bath and replacing the dye bath with a corresponding amount of water adjusted to pH 4.5 or less.

U.S. Pat. No. 4,579,762 (Ucci) discloses stain resistant nylon carpet in which the nylon fibers are made from a polymer modified to contain, as an integral part of its polymer chain, sufficient aromatic sulfonate units to improve the acid dye resistance of the fibers and in which the backing adhesive contains a fluorochemical in an amount sufficient to render the backing a barrier to liquids.

The present invention provides a method for imparting to fibrous polyamide materials stain resistance to acid colorants comprising applying by immersion or padding of the material or applying to the fiber during spinning thereof 0.01 to 0.3 weight percent, preferably 0.05 to 0.15 weight percent, based on the weight of said polyamide material of a stain resist agent and then applying sufficient stain resist agent by foam application to provide a stain resistance rating of at least about 5. Surprisingly, this two-step method of applying stain resist agent provides excellent stain resistance to acid colorants, provides improved stain resistance over application of the same amount of stain resist agent by immersion or padding only, and when the polyamide material is nylon carpet, provides excellent penetration, preferably at least about 85, more preferably at least about 95 percent, of the carpet tufts.

The FIGURE shows a photograph of a graduated rating scale which ranges from 1 to 8 used for evaluating carpet samples tested for stain resistance according to the test method set forth hereinafter. In the rating scale, 1 represents no discernible removal of red dye stain and 8 represents complete removal of dye stain.

The preferred stain resist agents useful in the present invention are (a) partially sulfonated novolak resins, (b) polymethacrylic acid, copolymers of methacrylic acid, or combinations of said polymethacrylic acid and said copolymers or methacrylic acid, or (c) combinations of (a) and (b).

The partially sulfonated novolak resins useful in this invention include known substances such as those compositions which are condensation products of formaldehyde with bis(hydroxyphenyl)sulfone and phenylsulfonic acid. Instead of, or in addition to, formaldehyde, another aldehyde such as, for example, acetaldehyde, furfuraldehyde, or benzaldehyde, can be used to make the condensation product. Also, other phenolic compounds such as, for example, bis(hydroxyphenyl)alkane, e.g., 2,2-bis(hydroxyphenyl)propane, and bis(hydroxyphenyl)ether compounds can be used instead of, or in addition to, the bis(hydroxyphenyl)sulfone. The sulfonated novolak resin is partially sulfonated, i.e., has a sulfonic acid equivalent weight of about 300–1200, preferably 400–900. Examples of such resins are disclosed in U.S. Pat. No. 4,592,940 (Blythe et al.) which is incorporated herein by reference for this purpose. Also commercially available sulfonated novolak products are available such as FX-369, a stain release product available from 3M Company, INTRATEX TM N, available from Crompton and Knowles Corp., ERIONAL TM PA, available from Ciba-Geigy Corp., NYLOFIXAN TM P, available from Sandoz, Ltd., MESITOL TM NBS, available from Mobay Chemical Corp., Resist #4, available from Lyndal Chemical Co., MAK TM 7 available from Allied Signal Inc., NRD 329 and NRD 332 available from DuPont Co., AMERIOLATE TM available from American Emulsions Co., Inc., and SYNTHABOND TM 1938, available from Piedmont Chemical Industries. Sulfonation of phenolic compounds is taught, for example, in *Sulfonated and Related Reactions*, E. E. Gilbert, Interscience Publishers, 1965. Condensation of phenol-formaldehyde resins is taught, for example, in *Phenolic Resins*, A Knopf et al., Springer-Verlag, 1985.

Component (b) useful in the present invention is polymethacrylic acid, copolymers of methacrylic acid, or combinations thereof and preferably is hydrophilic. As used herein, the term "methacrylic polymer", is intended to include the polymethacrylic acid homopolymer as well as polymers formed from methacrylic acid and one or more other monomers. The monomers useful for copolymerization with the methacrylic acid are monomers having ethylenic unsaturation. Such monomers include, for example, monocarboxylic acids, polycarboxylic acids, and anhydrides; substituted and unsubstituted esters and amides of carboxylic acids and anhydrides; nitriles; vinyl monomers; vinylidene monomers; monoolefinic and polyolefinic monomers; and heterocyclic monomers.

Representative monomers include, for example, acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, alkyl or cycloalkyl esters of the foregoing acids, the alkyl or cycloalkyl groups having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as, for example, acrylamide, methacrylamide, methylolacrylamide, and 1,1-dimethylsulfoethylacrylamide, acrylonitrile, methacrylonitrile, styrene, α-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil, and sulfonated dehydrated castor oil. Particularly useful monomers include, for example, ethyl acrylate, itaconic acid, sodium sulfostyrene, and sulfated castor oil. Of course, mixtures of the monomers can be copolymerized with the methacrylic acid.

The methacrylic polymers useful in the present invention can be prepared using methods well-known in the art for polymerization of ethylenically unsaturated monomers.

Preferably, the methacrylic acid comprises about 30 to 100 weight percent, more preferably 60 to 90 weight percent, of the methacrylic polymer. The optimum proportion of methacrylic acid in the polymer is dependent on the comonomer(s) used, the molecular weight of the copolymer, and the pH at which the material is applied. When water-insoluble comonomers, such as ethyl acrylate, are copolymerized with the methacrylic acid, they may comprise up to about 40 weight percent of the methacrylic polymers. When water-soluble monomers, such as acrylic acid or sulfoethyl acrylate are copolymerized with the methacrylic acid, the water-soluble comonomers preferably comprise no more than 30 weight percent of the methacrylic polymer and preferably the methacrylic polymer also comprises up to about 50 weight percent water-insoluble monomer.

Generally, the methacrylic polymer should be sufficiently water-soluble that uniform application and penetration of the polymer into the fiber surface can be achieved. However, when the polymer is excessively water soluble, acid colorant stain resistance and durability to cleaning may be reduced.

The glass transition temperature of the copolymer can be as low as about 35° C. although high glass transition temperatures are preferred. When polymer having high glass transition temperatures, i.e., as high as 230° C. or higher, are used, an additional benefit of improved soil resistance of the fibrous polyamide substrate can be obtained.

The weight average molecular weight and the number average molecular weight of the methacrylic polymer should be such that satisfactory stain resistance is provided by the polymer. Generally, the lower 90 weight percent of the polymer material preferably has a weight average molecular weight in the range of about 3000 to 100,000. Generally, the lower 90 weight percent of the polymer material preferably has a number average molecular weight in the range of about 500 to 20,000, more preferably in the range of about 800 to 10,000. Generally, more water-soluble comonomers are preferred when the molecular weight of the polymer is high and less water-soluble or water-insoluble comonomers are preferred when the molecular weight of the polymer is low.

Commercially available methacrylic polymers generally useful in the present invention include LEUKOTAN™ 970, Leukotan™ 1027, Leukotan™ 1028, and LEUKOTAN™ QR 1083, available from Rohm and Haas Company.

The amounts of the sulfonated novolak resin and the methacrylic polymers used should be sufficient to provide the desired degree of stain resistance to the polyamide substrate. Generally, when the substrate is nylon 66, lower application levels can be used than when the substrate is nylon 6 or wool. When the polyamide material is heat-set carpet yarn, yarn heat-set under moist conditions, e.g., in an autoclave, generally requires higher application levels than yarn heat-set under substantially dry conditions.

Generally, in the first step of the method of the present invention, the sulfonated novolak resin, the methacrylic polymer, or combinations thereof are applied from aqueous solutions at elevated temperature, e.g., 60° to 90° C. The pH of the solution should be below about 7, preferably below about 5. The stain resist agent can also be applied by padding an aqueous solution, at ambient temperature, of the stain resist agent onto the material or by applying the stain resist agent directly to the fiber, e.g., with a spin finish as the fiber is being spun. The amount of stain resist agent applied in this first step is 0.01 to 0.3 weight percent, preferably 0.05 to 0.15 weight percent, based on the weight of the polyamide material.

In the second step of the method of the present invention, stain resist agent, i.e., the sulfonated novolak resin, the methacrylic polymer or a blend thereof are applied from an aqueous foam. The foam is prepared using conventional foaming agents and techniques which are well known to those skilled in the art. The preferred foaming agents are those typically used in foam dyeing. Suitable foaming agents include FLUORAD™ FC-100, available from 3M Company, CYCLOTERIC™ BET W, available from Alcolac, Inc., MIRATAINE™ H2C, available from Miranol, Inc., and WITCONATE™ AOS, available from Witco Corp. The amount of stain resist agent applied in this second step is preferably 0.07 to 0.66 weight percent, more preferably 0.33 to 0.66 weight percent, based on the weight of the polyamide material.

Fluorochemical compositions for providing oil and water repellency can also be applied in conjunction with the sulfonated novolak resin and the methacrylic polymer. The fluorochemical composition is simply added in an appropriate amount to the treating solution.

The following non-limiting examples serve to illustrate the invention. In the following examples, all ratios are by weight and percentages are weight percent unless otherwise indicated.

In the examples, the following staining test was used: Ten ml of an aqueous solution containing 0.008 weight percent FD&C Red Dye Nol 40 and 0.04 weight percent citric acid is poured onto a 12.5 cm×12.5 cm test sample of carpet, which was dyed a light beige color, forming a stain about 5 cm in diameter. The solution is pressed into the sample using the open end of a 1.75 cm diameter test tube. The solution is allowed to remain on the test sample for eight hours at room temperature, i.e., about 22° C. The sample is rinsed under running tap water, dried, and then evaluated for staining using a graduated rating scale which ranges from 1 to 8, as shown in the drawing, where 1 represents no discernible removal of the red dye stain and 8 represents complete removal of the red dye stain. In general, an eight-hour stain resistance of at least about 5 is satisfactory, at least about 7 is good, and 8 is excellent.

The depth of penetration of the stain resist agent is measured as that portion of the carpet tuft which is substantially free of stain.

EXAMPLE 1

A 100 g sample of carpet (850 g/m$^2$, nylon 6, heat set under moist conditions) was immersed in 2000 g of an aqueous solution containing 0.3 g of a 32 weight percent aqueous solution of a copolymer of methacrylic acid, butyl acrylate and sulfonated castor oil in a molar ratio of 80/18/2, respectively, (Agent A) at pH 2.5 and temperature of 77° C. for 15 minutes to provide 0.1 weight percent Agent A solids based on the weight of the carpet. The sample was removed from the bath, rinsed, centrifuged and dried at 70° C. or 30 minutes at 121° C. for 5 minutes.

To 855 g water were added 140 g of the 32 weight percent aqueous solution of Agent A and 5 g FC-100, a foaming agent available from 3M Company. This solution was applied to the carpet using an FFT foam applicator, available from Gaston County Dyeing Machine Company, which was equipped with a static foam generator, at a pressure of 14–28 kPa at the carpet surface and a measured blow ratio of 45–50:1 to provide 0.32 weight percent Agent A solids based on the weight of the carpet. The carpet was dried for 20 minutes at 121° C. The carpet was tested for staining both initially and after 300,000 simulated traffics and for depth of penetration of the treating agent. The results are set forth in Table 1.

EXAMPLES 2–8

In Examples 2–8, carpets were treated and tested as in Example 1 except the following treating agents were used:

Agent B: FX-369 a sulfonated novolak resin provided as a 32 weight percent aqueous solution, available from 3M Company;

Agent C: a blend of Agent A and Agent B at a ratio of 6:1.

The treating agents, stain rating, and the penetration depth of the treating agent are set forth in Table 1.

COMPARATIVE EXAMPLE C1

A 100 g sample of carpet (850 g/m$^2$, nylon 6, heat set under moist conditions) was immersed in 2000 g of an aqueous solution containing 0.54 g of Agent A at pH 2.5 and temperature of 77° C. for 15 minutes to provide 0.54 weight percent Agent A solids based on the weight of the carpet. The sample was removed from the bath, rinsed, centrifuged and dried at 70° C. or 30 minutes and 121° C. for 5 minutes. The carpet was tested for staining both initially and after 300,000 simulated traffics and for depth of penetration of the treating agent. The results are set forth in Table 1.

COMPARATIVE EXAMPLE C2

A sample of carpet was treated and tested as in Comparative Example C1 except the stain resist agent used was Agent C. The test results are set forth in Table 1.

COMPARATIVE EXAMPLE C3–C5

In Comparative Examples C3–C5, to 855 g water were added 170 g aqueous solutions containing 54 g of Agent A, Agent B and Agent C, respectively, and 5 g FC-100, a foaming agent available from 3M Company. The solutions were applied to the carpet using the FFT foam applicator at a pressure of 14–28 kPa at the carpet surface and a measured blow ratio of 45–50:1 to provide 0.54 weight percent stain resist agent based on the weight of the carpet. The carpet was dried for 20 minutes at 121° C. The carpet was tested for staining both initially and after 300,000 simulated traffics and for depth of penetration of the treating agent. The results are set forth in Table 1.

TABLE 1

| Example | Immersion agent | Foam agent | Stain rating initial | Stain rating traffic | Percent penetration |
|---|---|---|---|---|---|
| 1 | A | A | 3.5 | 4.5 | 60 |
| 2 | A | C | 6.5 | 5.0 | 65 |
| 3 | A | B | 5.0 | 1.0 | 75 |
| 4 | B | B | 4.5 | 1.5 | 80 |
| 5 | B | A | 7.5 | 6.5 | 90 |
| 6 | B | C | 8.0 | 6.0 | 100 |
| C1 | A | — | 1.5 | 1.0 | 100 |
| C2 | C | — | 2.5 | 1.0 | 100 |
| C3 | — | A | 4.0 | 4.0 | 65 |
| C4 | — | B | 2.5 | 2.0 | 80 |
| C5 | — | C | 6.5 | 5.0 | 35 |

As can be seen from the data in Table 1, the two-step method of the present invention provides good stain resistance with generally good penetration. Those samples having foam applied polymethacrylic acid containing agents, Agent A and Agent C, also show excellent durability.

EXAMPLES 7–12 AND COMPARATIVE EXAMPLES C6–C10

In Examples 7–12, samples were treated and tested as in Examples 1–6, respectively, except the amount of stain resist agent applied in the foam step was increased to 0.67 weight percent solids based on the weight of the carpet. The results are set forth in Table 2.

In Comparative Examples C6–C10, samples were treated and tested as in Comparative Examples C1–C5, respectively, except the amount of stain resist agent was increased to 0.77 weight percent solids based on the weight of the carpet. The results are set forth in Table 2.

TABLE 2

| Example | Immersion agent | Foam agent | Stain rating initial | Stain rating traffic | Percent penetration |
|---|---|---|---|---|---|
| 7 | A | A | 5.0 | 6.0 | 50 |
| 8 | A | C | 7.5 | 5.5 | 80 |
| 9 | A | B | 7.0 | 1.0 | 90 |
| 10 | B | B | 6.0 | 1.5 | 80 |
| 11 | B | A | 7.5 | 7.0 | 100 |
| 12 | B | C | 8.0 | 7.5 | 100 |
| C6 | A | — | 2.0 | 1.0 | 100 |
| C7 | C | — | 4.0 | 1.0 | 100 |
| C8 | — | A | 4.5 | 4.5 | 75 |
| C9 | — | B | 2.5 | 1.5 | 80 |
| C10 | — | C | 6.0 | 6.0 | 60 |

As can be seen from the data in Table 2, the use of higher levels of stain resist agent generally provides increased stain ratings.

EXAMPLES 13–14

In Example 13, an aqueous solution was prepared containing 3.5 g/L Agent B. The solution was padded onto a sample of nylon 66 carpet at ambient temperature with a wet pickup of 90 weight percent based on the weight of the carpet to provide 0.1 weight percent Agent B solids based on the weight of the carpet. The carpet was steamed for 2 minutes, rinsed and dried at 70° C. for 15 minutes and 121° C. for 5 minutes. Agent C was then applied to the carpet sample using the foam procedure as described in Example 1 such that 0.28 weight percent Agent C solids based on the weight of the carpet were applied. The carpet was dried for 20 minutes at 121° C. The carpet was tested for initial staining and for depth of penetration of the treating agent. The results are set forth in Table 3.

In Example 14, a carpet sample was prepared and tested as in Example 13 except the amounts of staining agent applied were 0.05 weight percent Agent B solids based on the weight of the carpet in the padding step and 0.56 weight percent Agent C solids based on the weight of the carpet in the foam step.

TABLE 3

| Example | Stain rating initial | Percent penetration |
|---|---|---|
| 13 | 8.0 | 100 |
| 14 | 8.0 | 95 |

As can be seen from the data in Table 3, application of stain resist agent by padding prior to application of stain resist agent by foam provides excellent penetration and stain resistance.

The various modifications and alterations of this invention will be apparent to those skilled in the art without departing from the scope and spirit of this invention and this invention should not be restricted to that set forth herein for illustrative purposes.

What is claimed is:

1. A method for imparting to fibrous polyamide materials stain resistance to acid colorants comprising (a) applying by immersion or padding of said material or applying to the fiber during spinning thereof 0.01 to 0.3 weight percent based on the weight of said polyamide material of a stain resist agent selected from the group consisting of (i) a partially sulfonated novolak resin, (ii) polymethacrylic acid, copolymers of methacrylic copolymers of methacrylic acid, or combinations of said polymethacrylic acid and said copolymers of methacrylic acid, and (iii) combinations of (i) and (ii) and then (b) applying sufficient stain resist agent by foam application to provide a stain resistance rating of at least about 5.

2. The method of claim 1 wherein said stain resist agent is applied in step (a) by immersion in a bath at a temperature of 60° to 90° C. and a pH of less than about 7.

3. The method of claim 1 wherein said stain resist agent is applied in step (a) by padding a solution of stain resist agent at ambient temperature onto said fibrous polyamide material.

4. The method of claim 1 further comprising drying said material.

5. The method of claim 2 wherein said pH is less than about 5.

6. The method of claim 1 wherein about 0.05 to 0.15 weight percent stain resist agent based on the weight of said polyamide material is applied in step (a).

7. The method of claim 1 wherein about 0.07 to 0.66 weight percent stain resist agent based on the weight of said polyamide material is applied in step (b).

8. The method of claim 1 wherein about 0.33 to 0.66 weight percent stain resist agent based on the weight of said polyamide material is applied in step (b).

9. The method of claim 1 wherein said stain resistance rating is at least about 7.

* * * * *

UNITED STATES PATENT AND TRADEMARK OFFICE

CERTIFICATE OF CORRECTION

PATENT NO. : 5,074,883

DATED : December 24, 1991

INVENTOR(S) : Shou-Lu Grace Wang

It is certified that error appears in the above-identified patent and that said Letters Patent is hereby corrected as shown below:

| | |
|---|---|
| Col. 3, line 59 | "Leukotan" (both instances) should be --LEUKOTAN-- |
| Col. 4, line 45 | "nol" should read --No.-- |
| Col. 5, line 6 | "or" should read --for-- |
| Col. 5, line 6 | "at 121° C." should read --and 121° C. -- |
| Col. 8, lines 1 and 2 | delete "copolymers of methacrylic" (second occurance) |

Signed and Sealed this

Twenty-ninth Day of June, 1993

*Attest:*

Michael K. Kirk

MICHAEL K. KIRK

*Attesting Officer*

*Acting Commissioner of Patents and Trademarks*